United States Patent [19]

Lancsek

[11] Patent Number: 4,859,494

[45] Date of Patent: Aug. 22, 1989

[54] METHOD AND ARTICLE HAVING ELECTROLESS METAL PLATING

[75] Inventor: Thomas S. Lancsek, Morrisville, Pa. 19067

[73] Assignee: Surface Technology, Inc., Princeton, N.J.

[21] Appl. No.: 234,703

[22] Filed: Aug. 22, 1988

[51] Int. Cl.[4] ..... B05D 3/14

[52] U.S. Cl. ..... 427/47; 427/443.1; 427/304; 427/305

[58] Field of Search ..... 427/47, 443.1, 304, 427/305

[56] References Cited

U.S. PATENT DOCUMENTS

| | | | |
|---|---|---|---|
| 3,869,356 | 3/1975 | Long | 204/38.4 |
| 3,905,776 | 9/1975 | Long | 204/28 |
| 4,017,265 | 4/1977 | Taylor | 427/305 |
| 4,244,788 | 1/1981 | Faulkner | 204/15 |
| 4,292,120 | 9/1981 | Nacci | 427/29 |
| 4,358,923 | 11/1982 | Feldstein | 427/443.1 |
| 4,547,407 | 10/1985 | Spencer | 427/443.1 |

*Primary Examiner*—Shrive Beck
*Assistant Examiner*—Vi Duong Dang

[57] ABSTRACT

A method for the electroless coating of ferromagnetic substrates substantially free of microspheres or other unwanted auxiliary matter, thereby reducing the roughness of the coated articles. The method and articles produced are subjected to a magnetic field and demagnetized prior to the plating step. The method is of particular utility in the coating of textile machinery parts operating at high rotational speed in the minimizing of dust and yarn damage. The method is also of great utility in the deposition of composite electroless coatings.

21 Claims, 1 Drawing Sheet

FIG. 1
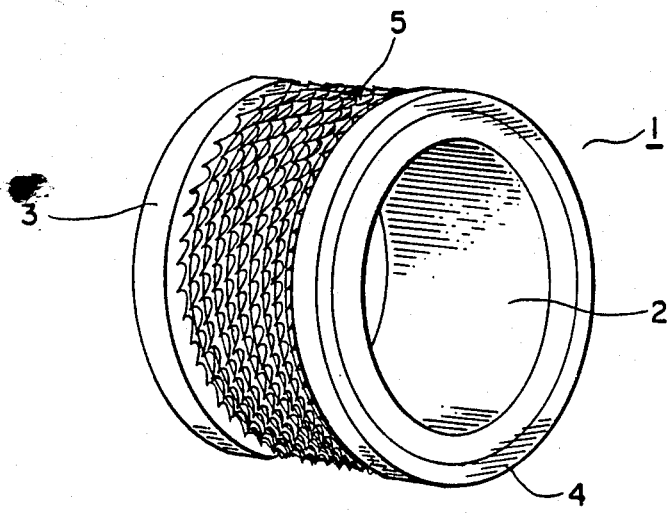
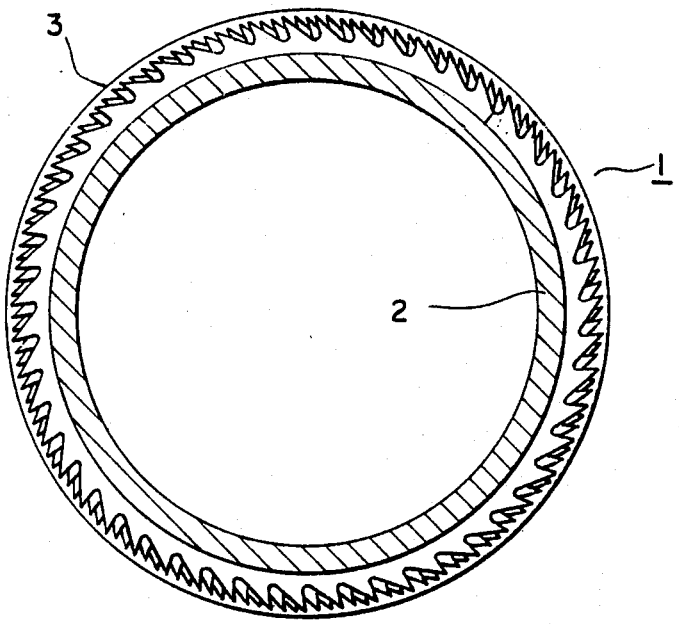
FIG. 2

METHOD AND ARTICLE HAVING ELECTROLESS METAL PLATING

TECHNICAL FIELD

This invention relates to a method of manufacturing a combing roll (beater roll) used in open-end spinning and the combing roll produced thereby. More particularly, this invention refers to the method of forming a coating on said combing roll.

BACKGROUND OF THE INVENTION

It is well known in the art that sharp toothed wire or the like is used in many areas of carding and spinning and related textile operations. In open-end spinning, for example, a sliver of separate fibers is fed into a combing roller which is provided with metallic wires having saw teeth would around the periphery of the roller. The wires contact the fibers and comb them. From the combing roller, the fibers are then transferred to a rotor where the combed fibers are twisted to form a yarn which is then transferred to a take-up spool. Examples of combing rollers and various toothed combing wires associated therewith can be found with reference to U.S. Pat. Nos. 2,937,413; 4,233,711; 2,731,676; 4,435,953; and 3,833,968 which are incorporated herein by reference. An alternative device to the combing roller is a pin-ring which functions in the same way but employs a multiplicity of pins extending from the roller (sleeve) rather than the toothed surface. For the purpose of this invention, the terms combing rolls, carding rolls, pin-rings, and beater rolls (or rollers) are used interchangeably.

These rollers are currently driven at speeds of 5,000–10,000 RPM (as described in U.S. Pat. No. 4,435,953) with higher speeds expected in the future which cause tooth wear with time, and thus reduce the efficiency of the entire operation by lowering the quality of the product produced over time and lowering the general efficiency of the combing process causing knots and neps in the yarn produced, and causing yarn breaks which cause the individual spinning position to shut down, or produce defective yarn.

The general make-up of the wire (or pins, in the case of pin ring beater rolls) containing the teeth that do the fiber combing is made up of two different parts: the base of the wire, and the toothed portion of the wire. This wire is generally made from steel. Methods of manufacture and final wire or tooth specifications vary with manufacturer, but common practice for its manufacture is starting with a wire having an initially round section, such section being modified by a process of rolling to give a wire which is finally strip-like with a rib running along one side to constitute a base or foundation for the finished strip (as described in U.S. Pat. No. 2,731,676). This base portion is then imbedded in the comber roller, be it a solid piece or a sleeve after suitable treatment to make the wire metallurgically suitable in terms of hardness, ductility, and hopefully wear resistance.

One commonly used method for the formation of the toothed portion itself is a punching operation which imparts the shape of the tooth along with the proper angles for the most efficient carding and combing of a specific type of fiber.

After punching, another mechanical process (described in U.S. Pat. No. 4,233,711) which is used is a grinding operation. This grinding operation has the primary function of imparting an exact evenness to the teeth, making them all exactly uniform, as well as removing any unwanted defects from the punching operation. Also as a final step, some manufacturers post-treat this wire using "needle finishing" which imparts a smoothness to the sides of the teeth, along with a very light or small amount of directional lines in the steel tooth which run approximately parallel to the base portion of the wire. This also helps the efficiency of the combing operation which reduces undesired "loading" of the teeth.

With use, the degradation of the tooth geometry occurs, namely the dulling of the tip of the tooth and the dulling of the leading tooth edges along with an eventual general wearing of the entire tooth portion of the wire. In order to prevent excessive wear, or slow down the wearing process, many coatings or wire treatments have been devised and attempted, as can be seen in the following methods and patents: heat treatment of carbonitriding, surface hardening by carbonitriding, or electrospark coating including vanadium carbide, chromium carbide, tungsten carbide, titanium carbide, zirconium carbide, hafnium carbide, and iron boride, which are applied by the diffusion treatment process. In still another process a chromium layer is electrodeposited onto the teeth of the combing roll, imparting a hard chromium wear resistant layer over the steel tooth (as described in U.S. Pat. No. 4,169,019).

A more popular and seemingly more wide-spread method of protecting the combing teeth is by the electroless deposition of a "composite" coating. The composite coatings usually are comprised of small, wear resistant particles which are co-deposited with an electroless metal matrix (usually, but not limited to, the nickel-phosphorous type matrix). The wear resistant particles can range from aluminum oxides and silicon carbides, to natural and synthetic diamonds, both polycrystalline and/or monocrystalline in nature, as well as lubricating particles. These coatings and the like may be applied according to the technology taught in U.S. Pat. Nos. 3,940,512; 4,358,923; 4,547,407; 4,419,390; and Re. 29,285, which patents are incorporated herein by reference. Review of this technology is made in Metal Finishing, August (1983) p. 35.

It is desireable that these electroless and electroless composite coatings be as smooth and uniform as possible. However, it has been observed that on many occasions small auxiliary matter containing the electroless metal in the shape of balls, or microspheres, form on the teeth which lead to a condition which may cause damage to the yarn to be processed along with the combing roll and excess dusting. I have now discovered a solution for this problem. It may be noted that though the problem and solution is described herein in terms of a combing roller, the problem and the solution set forth herein are equally applicable to the electroless plating of any ferromagnetic material with nickel or cobalt or other electrolessly deposited metal and particularly with a composite nickel or cobalt coating.

SUMMARY OF THE INVENTION

Broadly, the invention comprises a method for forming an electrolessly plated metal such as nickel or cobalt coating on a ferromagnetic substrate, including the step of degaussing (demagnetizing) the substrate prior to immersion in the plating bath.

As more particularly set forth herein, the invention is described in terms of a method for making a device for combing yarn wherein the combing means on the device is of a ferromagnetic material and the degaussing device produced thereby which device is essentially free of microspheres on the coating is characterized in that it is demagnetized.

BRIEF DESCRIPTION OF THE DRAWINGS

FIG. 1 is an isometric elevation view of a combing roll used for carding yarn.

FIG. 2 is a side cross sectional view of the combing roll shown in FIG. 1.

DETAILED DESCRIPTION OF THE INVENTION

Referring to FIGS. 1 and 2, there is shown a combing roll 1 having a hollow cylindrical body 2 with flanged end portions 3 and 4. Around the outer periphery of the combing roll 1 within the region between the flanged ends 3 and 4 is a plurality of spaced saw toothed wires 5. The body 2 may be made of any suitable material, e.g., aluminum, steel, plastic, etc. The wires 5 are made from a ferromagnetic material, e.g., steel, and are provided with an electroless metal composite coating thereon, which coating may also be present on the body 2 of the roll 1. Ordinarily when an electroless nickel or cobalt deposit or nickel or cobalt composite coating is deposited on the roll 1, small microspheres tend to form on the ferromagnetic wire which adversely affect the combing rolls in use. I have now discovered that by exposing the roll (or wire) to a magnetic field such as one created by an alternating current prior to plating, the formation of the microspheres is essentially eliminated. It is believed that the applied magnetic field degausses any residual magnetism in ferromagnetic portions of the substrate to be plated and that this degaussing results in a substantially microsphere-free coating.

Procedurally, the part to be degaussed is placed in a degaussing chamber of a degaussing apparatus, or within close proximity to such, or in a suitable magnetic field.

Such degaussing apparatus is well known and commercially available. The specific unit for degaussing used, called a demagnetizer, was a 220 volt, A.C. unit with A.C. transformer. The field strength of this particular unit is not known, but the field amperage was ~500–1,000 amps. Each beater roll was held at the extreme edge of the field to eliminate only a residual magnetic field. For a stronger magnetic field the part would be put directly into the field, or a much weaker demagnetizing field could be used.

These units come in either air cooked, or water cooled, models, with some being designed for intermittant use and some designed for continuous use.

Each unit was held approximately 1" away from the field coil and rotated about its axis twice in a total time of about 5–10 seconds.

In reducing this invention to practice, more than fifty units were treated as above, and subsequently plated with a composite electroless nickel of approximately 20 microns in thickness and containing 2 micron size diamond particles. Of the total units demagnetized, none showed any of the defects commonly seen in the absence of the magnetic (demagnetization) treatment.

While the reduction to practice was carried out as described above, it should be obvious to one skilled in the art that many modifications can be implemented including the magnetic treatment (degaussing) of the wire prior to the insertion of the wire within the base metal or holder.

The plating of the composite diamond coating is carried forth in accordance with some of the procedures described in the above patents, as well as U.S. Pats. Nos. 3,940,512; 4,358,923; 4,547,407; 4,419,370; and Re. No. 29,285, all of which are included by reference. It is noted that generally the plating procedures are carried out after suitable cleaning and activation of the part to be plated.

Though the present invention has provided a solution to serious technical problems, the exact cause giving rise to the noted defects is not fully understood. It is speculated that these defects arise due to the inherent instability of electroless plating formulations.

What is claimed is:

1. A method of forming an electrolessly plated metal deposit on a ferromagnetic substrate comprising the step of demagnetizing the substrate prior to plating.

2. The method recited in claim 1 wherein said metal is selected from the group consisting of nickel and cobalt.

3. The method recited in claim 1 wherein said metal deposit is a composite coating.

4. The method recited in claim 1 wherein said metal deposit is a nickel diamond composite.

5. The method recited in claim 1 wherein said substrate is a textile machinery part.

6. The method recited in claim 1 wherein said substrate is a textile machinery part and wherein said metal is a composite diamond coating.

7. The method recited in claim 1 wherein said metal is deposited from a composition comprising a nickel salt and a salt of hypophosphite anion.

8. The method recited in claim 1 wherein said metal deposit is a composite diamond coating comprising polycrystalline diamond.

9. The method recited in claim 1 wherein said metal deposit is a composite electroless coating containing wear-resistant particles.

10. The method recited in claim 1 wherein said metal deposit is a composite electroless coating containing lubricating particles.

11. A method of making a combing device for yarn said device including a ferromagnetic member for combing said yarn including the steps of demagnetizing said ferromagnetic member and electrolessly plating a metal coating thereon.

12. The method recited in claim 11 wherein said metal is selected from the group consisting of nickel and cobalt.

13. The method recited in claim 11 wherein said metal deposit is a composite coating.

14. The method recited in claim 11 wherein said metal deposit is a nickel diamond composite.

15. The method recited in claim 11 wherein said substrate is a textile machinery part.

16. The method recited in claim 11 wherein said substrate is a textile machinery part and wherein said metal is a composite diamond coating.

17. The method recited in claim 11 wherein said metal is deposited from a composition comprising a nickel salt and a salt of hypophosphite anion.

18. The method recited in claim 11 wherein said metal deposit is a composite diamond coating comprising polycrystalline diamond.

19. The method recited in claim 11 wherein said metal deposit is a composite electroless coating containing wear-resistant particles.

20. The method recited in claim 11 wherein said metal deposit is a composite electroless coating containing lubricating particles.

21. A method for obtaining a smoother electrolessly metallized ferromagnetic substrate comprising the step of demagnetizing the substrate prior to the step of electroless metallization.

* * * * *

UNITED STATES PATENT AND TRADEMARK OFFICE

CERTIFICATE OF CORRECTION

PATENT NO. : 4,859,494

DATED : Aug. 22, 1989

INVENTOR(S) : Thomas S. Lancsek

It is certified that error appears in the above-identified patent and that said Letters Patent is hereby corrected as shown below:

Col. 1, line 18, change "would" to --wound--.
Col. 3, line 52, change "cooked" to --cooled--.
Col. 4, line 19, claim 1, after "plating" insert --and electrolessly plating a metal coating thereon--.
Col. 6, line 6, claim 21, after "metallization" insert -- and electrolessly plating a metal coating thereon--.

Signed and Sealed this

Twenty-fourth Day of July, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,859,494

DATED : August 22, 1989

INVENTOR(S) : Thomas S. Lancsek

It is certified that error appears in the above-identified patent and that said Letters Patent is hereby corrected as shown below:

TITLE PAGE:

[63] Related U.S. Application Data

Division of Ser. No. 041,998, Apr. 27, 1987, abandoned.--;

Column 1, line 4, under the title of the invention insert the following:

--This application is a divisional application to co-pending Ser. No. 041,998 filed Apr. 27, 1987 now abandoned.--.

Signed and Sealed this

Sixteenth Day of July, 1991

*Attest:*

*Attesting Officer*

HARRY F. MANBECK, JR.

*Commissioner of Patents and Trademarks*